US005303512A

United States Patent [19]

Tsujiuchi et al.

[11] Patent Number: 5,303,512

[45] Date of Patent: Apr. 19, 1994

[54] METHOD AND APPARATUS FOR GRINDING A CYLINDRICAL SURFACE OF A WORKPIECE BY TRAVERSE GRINDING

[75] Inventors: Toshio Tsujiuchi; Tomoyasu Imai, both of Kariya; Norio Ohta, Okazaki; Yukio Oda, Kariya; Ryohei Mukai, Nagoya; Hisashi Nakamura, Nagoya; Takayuki Yoshimi, Toyohashi, all of Japan

[73] Assignee: Toyoda Koki Kabushiki Kaisha, Kariya, Japan

[21] Appl. No.: 902,822

[22] Filed: Jun. 23, 1992

[30] Foreign Application Priority Data

Jun. 25, 1991 [JP] Japan ..... 3-153039
Jun. 25, 1991 [JP] Japan ..... 3-153040
Sep. 24, 1991 [JP] Japan ..... 3-243714

[51] Int. Cl.[5] ..... B24B 5/04; B24B 49/16

[52] U.S. Cl. ..... 51/165.77; 51/165.71; 51/289 R

[58] Field of Search ..... 51/289 R, 165.76, 165.77, 51/324, 326, 327, 165.75

[56] References Cited

U.S. PATENT DOCUMENTS 3,333,370 8/1967 Parrella ..... 51/289 R
3,751,860 8/1973 Tittle ..... 51/289 R
4,294,045 10/1981 Enomoto et al. ..... 51/165.77
4,905,417 3/1990 Oda et al. ..... 51/165 TP

FOREIGN PATENT DOCUMENTS 0239161 9/1987 European Pat. Off. .
0192750 11/1983 Japan ..... 51/165.77
1096083 6/1984 U.S.S.R. ..... 51/165.77

OTHER PUBLICATIONS

Machinery and Production Engineering, vol. 145, No. 3717, Jun. 3, 1987, pp. 57-58, 61-62, Horton Kirby, "Finding the Right Approach".

F. H. Colvin, et al., "Grinding Practice", Second Edition, Third Impression, 1943, pp. 28-29, 35-36.

Society of Manufacturing Engineers, Tool and Manufacturing Engineers Handbook, Fourth Edition, vol. 1, Chapter 11, T. J. Drozda, et al., "Principles of Grinding", 4 pages.

*Primary Examiner*—Robert A. Rose

*Attorney, Agent, or Firm*—Oblon, Spivak, McClelland, Maier & Neustadt

[57] ABSTRACT

A method and apparatus for grinding a cylindrical surface of a workpiece by a traverse movement of a grinding wheel having a relatively narrow grinding surface. To improve the cylindricity of cylindrical surface, the traverse grinding is divided into a rough traverse grinding and a finish traverse grinding. In the rough traverse grinding, a traverse girding is carried out with a large depth of cut which would causes a deterioration of the cylindricity at one end of the cylindrical surface. In the finish traverse grinding, a traverse girding is carried out with a small depth of cut to improve the cylindricity. In another embodiment, one of grinding conditions such as the traverse speed of the grinding wheel, the rotational speed of the workpiece and the peripheral speed of the grinding wheel is changed when the grinding wheel approaches an end of the cylindrical surface at which the traverse grinding ends so as to make the grinding force constant, thereby improving the cylindricity of the cylindrical surface. In other embodiments, the position of the wheel head is compensated based upon the measured diameter of the cylindrical surface so that the entire area of the cylindrical surface has a desired diameter. This compensation also improves the cylindricity of the cylindrical surface.

10 Claims, 14 Drawing Sheets

FIG. 8

| K | Vc |
|---|---|
| 0 | 1. 0 |
| 1 | 1. 1 |
| 2 | 1. 2 |
| 3 | 1. 3 |
| 4 | 1. 4 |
| . | . |
| . | . |
| . | . |
| 9 | 1. 88 |
| 10 | 1. 9 |

FIG. 14

22

| |
|---|
| TRIAL MACHINING PROGRAM |
| ORDINARY MACHINING PROGRAM |
| COMPENSATION VALUE TABLE |

FIG. 15

| PRESENT POSITION | COMPE. VALUE |
|---|---|
| Z1 | Vc1 |
| Z2 | Vc2 |
| Z3 | Vc3 |
| Z4 | Vc4 |
| Z5 | Vc5 |
| Z6 | Vc6 |
| Z7 | Vc7 |
| Z8 | Vc8 |
| Z9 | Vc9 |
| ..... | ..... |

METHOD AND APPARATUS FOR GRINDING A CYLINDRICAL SURFACE OF A WORKPIECE BY TRAVERSE GRINDING

BACKGROUND OF THE INVENTION

1. Field of the Invention

The present invention relates to a method and an apparatus for grinding a cylindrical workpiece and, more particularly, to a method and an apparatus for grinding a cylindrical surface of a workpiece by traverse grinding.

2. Discussion of the Prior Art

Conventionally, when the axial length of a cylindrical surface of a workpiece is longer than the width of a grinding wheel, the cylindrical surface is ground by traverse grinding. In such traverse grinding, the grinding wheel is firstly advanced toward the rotational axis of a workpiece to carry out infeed movement into the cylindrical surface thereof, and a table supporting the workpiece is then moved in a direction parallel to the rotational axis of the workpiece so that the whole area of the cylindrical surface of the workpiece is ground by the grinding wheel.

Further, when it is required to ground a cylindrical surface of a workpiece at a high speed, so-called one-path traverse grinding is used for grinding the cylindrical surface, wherein the cylindrical surface is ground into a desired final dimension by a single traverse movement of the grinding wheel under the state that a large depth of cut has been given.

Such high speed traverse grinding, however has a problem that one end la of the workpiece 1 at which traverse grinding ends is excessively ground as compared to the rest of the cylindrical surface of the workpiece 1, as shown in FIG. 1. This causes a deterioration of the cylindricity of the outer surface.

The excessive removal at the end la is caused by a change in the grinding force during such traverse grinding. Namely, the grinding force is decreased when the grinding wheel approaches the end la of the workpiece 1, because the width b of an effective part of the grinding surface which actually carries out the grinding function decreases, as shown in FIGS. 2(i a) and 2(*b*). For example, when the width of the effective part of the grinding surface becomes the half of the width of the grinding surface B, the grinding force also becomes half. This decrease of the grinding force causes an increase of the grinding efficiency, and an decrease of the deformation amount in the radial direction of the workpiece 1, resulting in an excessive grinding at the end of the cylindrical surface.

SUMMARY OF THE INVENTION

Accordingly, it is an object of the present invention to provide an improved method and an apparatus for grinding a cylindrical surface of a workpiece by traverse grinding which is capable of preventing one end of the cylindrical surface from being excessively ground, thereby improving the cylindricity of the workpiece.

Briefly, the present invention provides a method and an apparatus for grinding a cylindrical surface of a workpiece by a traverse movement of a grinding wheel having a relatively small width.

In a first preferred embodiment, traverse grinding operation is divided into a rough traverse grinding and a finish traverse grinding to grind the cylindrical surface efficiently and to improve the cylindricity of the cylindrical surface. In the rough traverse grinding, the depth of cut is determined to leave an allowance for the finish traverse grinding which is larger than the amount of excessive removal at the end of the rough traverse grinding. In the finish traverse grinding, a traverse grinding is carried out with a small depth of cut to improve the cylindricity of the cylindrical surface.

In second embodiment, one of grinding conditions such as the traverse speed of the grinding wheel, the rotational speed of the workpiece and the peripheral speed of the grinding wheel is changed when the grinding wheel approaches an end of the cylindrical surface, at which the traverse grinding ends, so as to make the grinding force constant regardless of a decease in the width of the effective portion of the grinding surface which actually carries out the grinding function. This improves the cylindricity of the cylindrical surface.

In third and forth embodiments, the position of the wheel head is compensated based upon the measured diameter of the cylindrical surface so that the entire area of the cylindrical surface is accurately ground to have a desired diameter. This compensation also improves the cylindricity of the cylindrical surface.

With those arrangements, it is possible to prevent one end of the cylindrical surface from being excessively ground at the end of the traverse grinding. It is therefore possible to grind the cylindrical surface to have a desired final shape and a desired cylindricity.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 1 is a chart showing a workpiece ground by a conventional traverse grinding;

FIGS. 2 (*a*) and (*b*) are explanatory charts showing a change in the width of the effective portion of the grinding surface which contacts with a cylindrical surface of a workpiece;

FIG. 6 (*b*) is an explanatory chart showing a change in the positional relationship between the grinding wheel and the workpiece in the finish traverse grinding;

FIG. 8 is a chart showing the compensation value table formed in the memory shown in FIG. 3;

Figure 11:
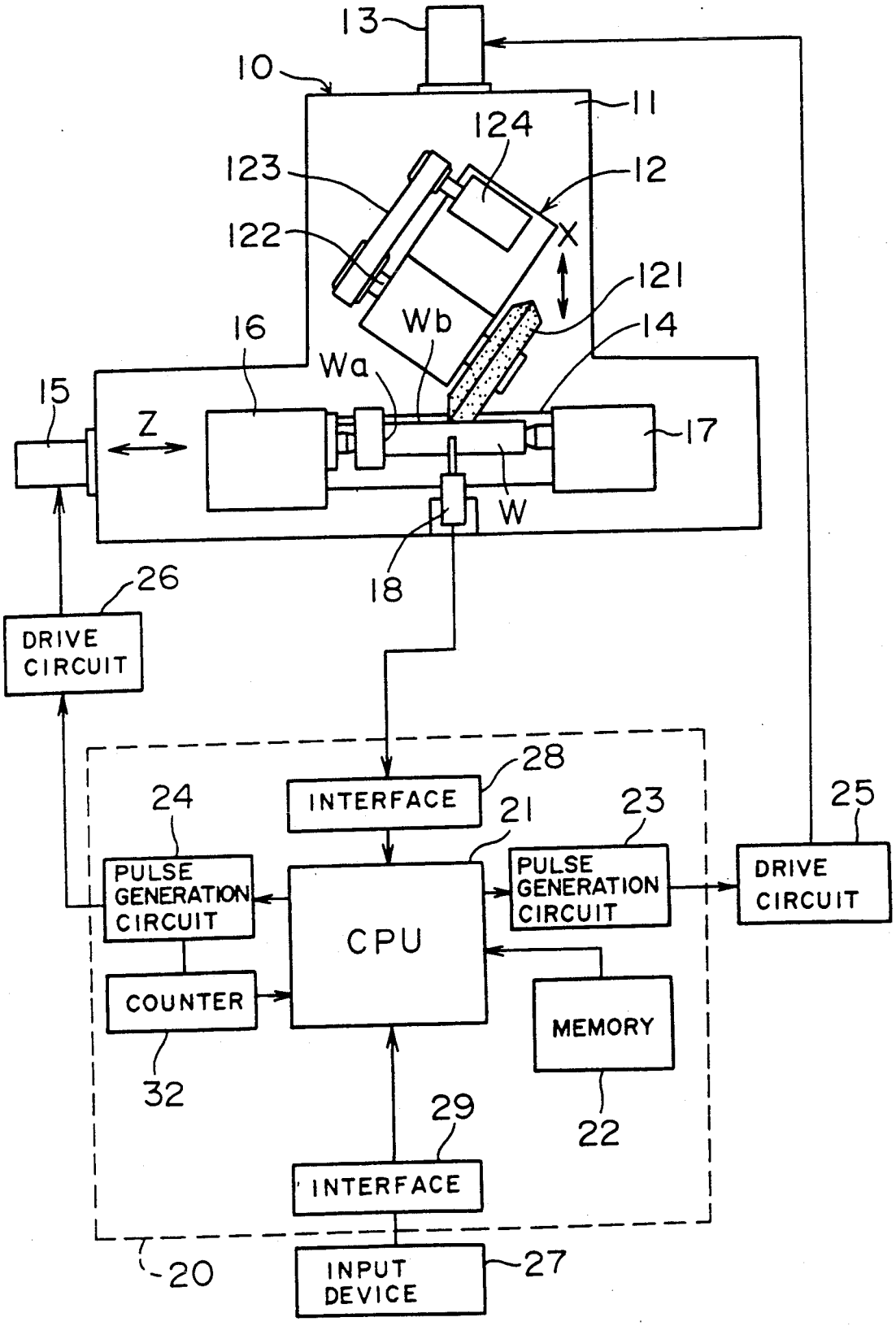
FIG. 11 is a schematic plan view of a grinding machine, which is combined with a block diagram of a numerical controller, according to a third embodiment of the present invention.
Figure 13:
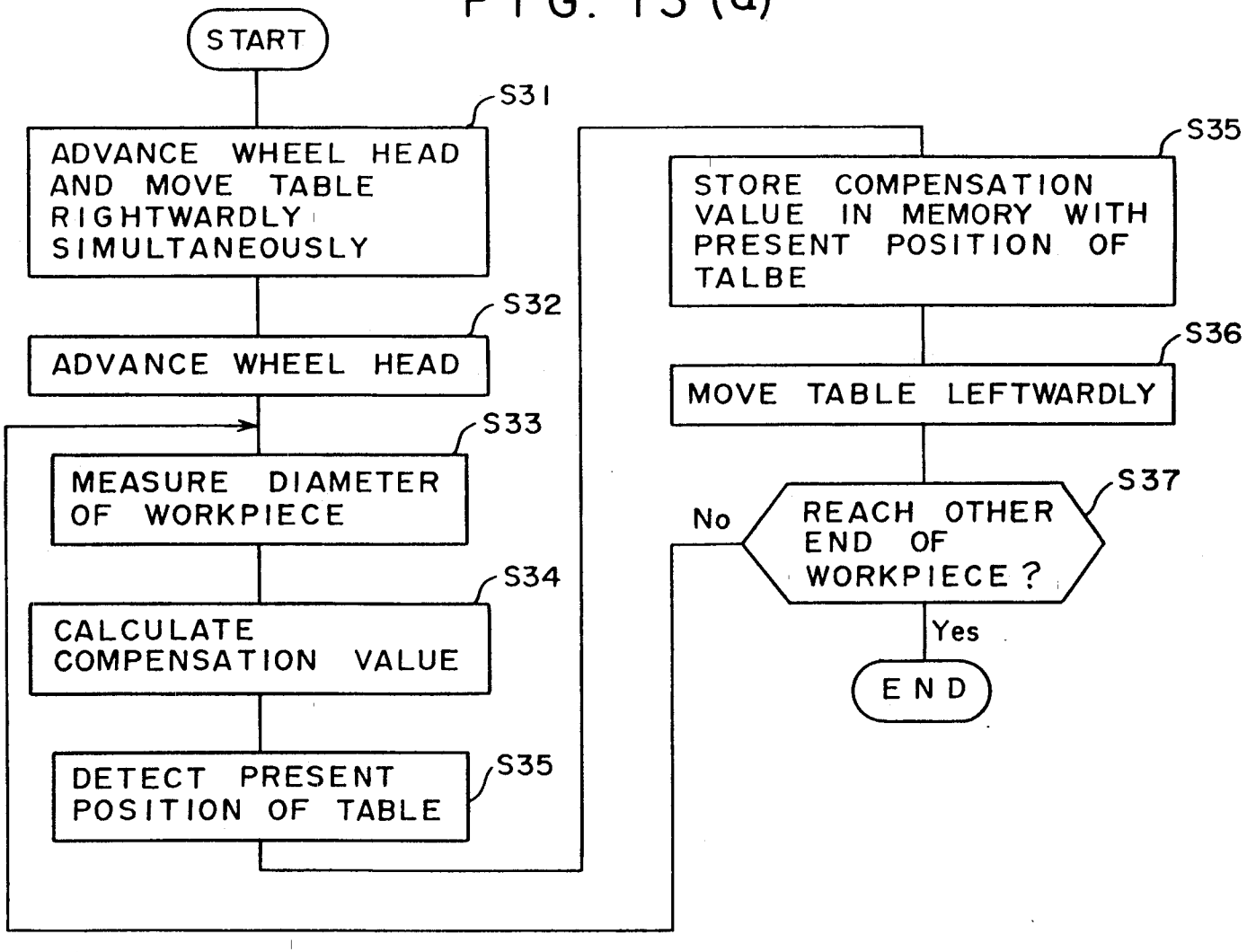
Figure 13:
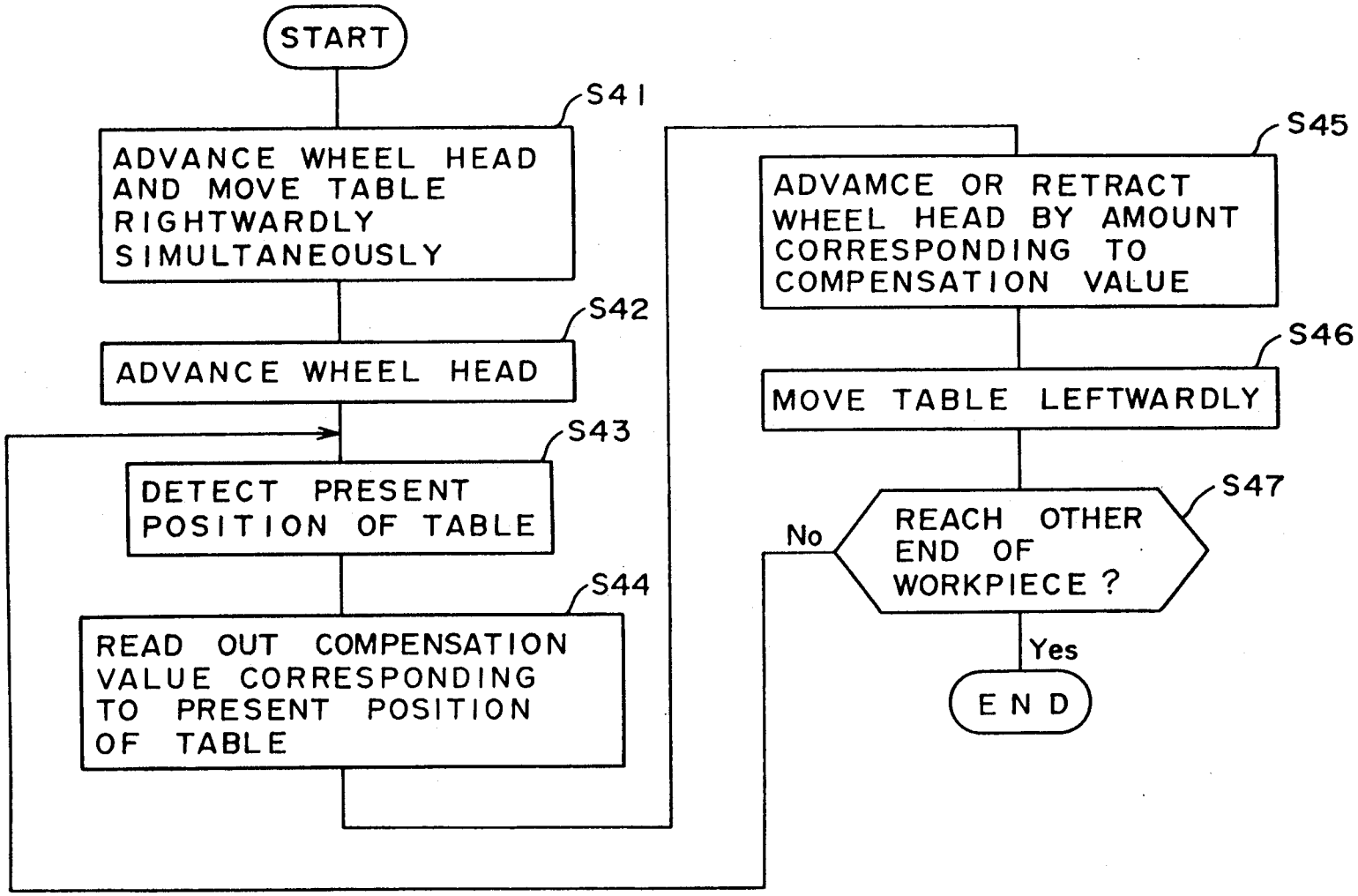
Figure 16:
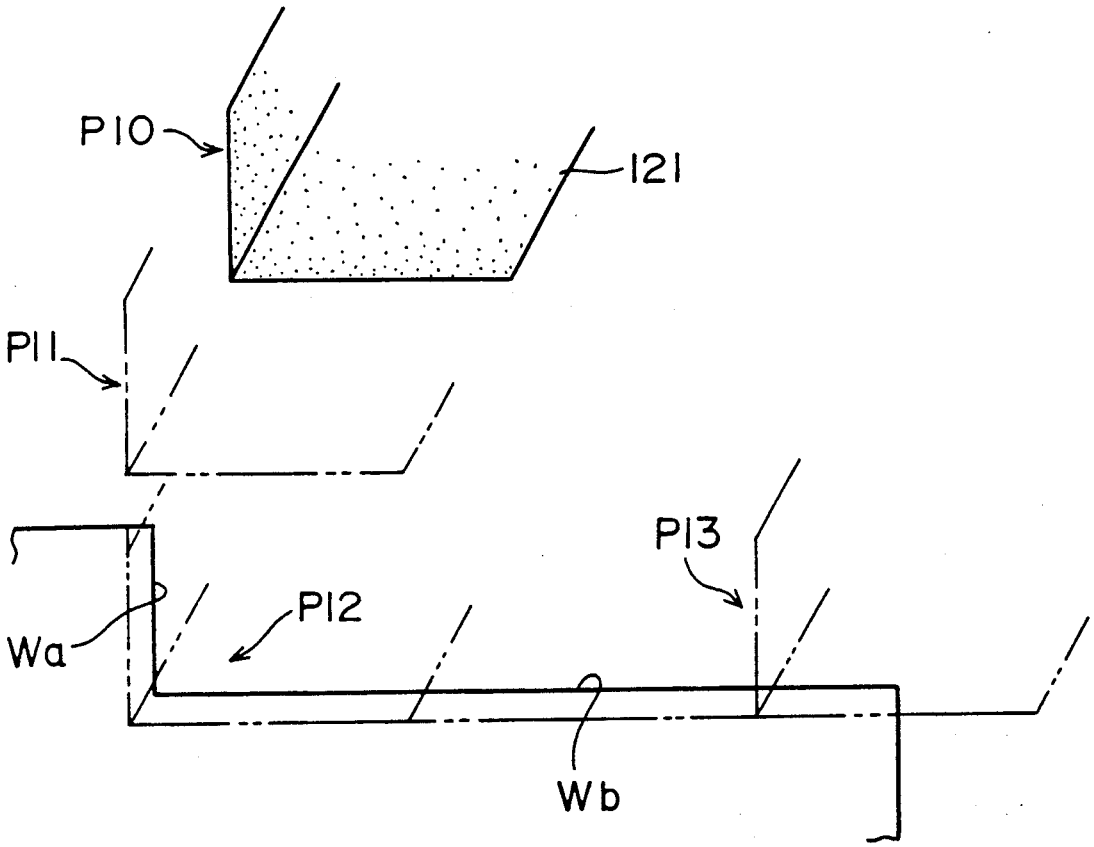

FIGS. 13 (*a*) and 13 (*b*) are flowcharts illustrating the operation of the CPU shown in FIG. 11 according to the forth embodiment;

FIG. 14 is a chart showing the contents of the memory shown in FIG. 11;

FIG. 15 is a chart showing the compensation value table memorized in the memory shown in FIG. 11; and FIG. 16 is an explanatory chart showing a change in traverse speed of the table in the third and forth embodiments.

DETAILED DESCRIPTION OF THE PREFERRED EMBODIMENTS

The preferred embodiments of the present invention will now be described with reference to drawings.

First Embodiment

In this first embodiment, cylindrical surfaces of a workpiece is ground by a rough traverse grinding and a finish traverse grinding to grind the cylindrical surface efficiently and to improve the cylindricity of the cylindrical surface.

Figure 1:
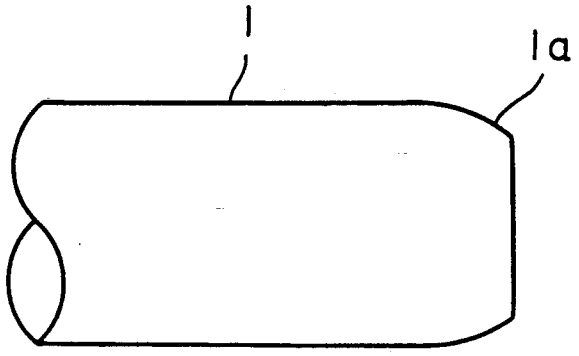
Figure 2:
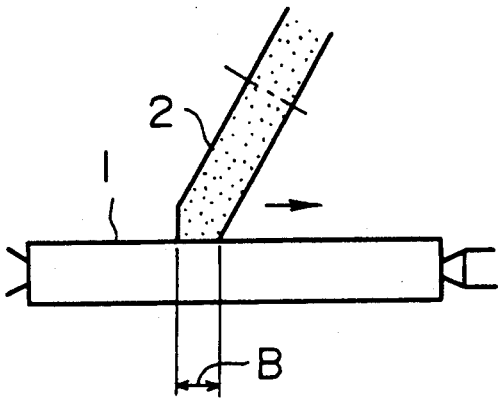
Figure 2:
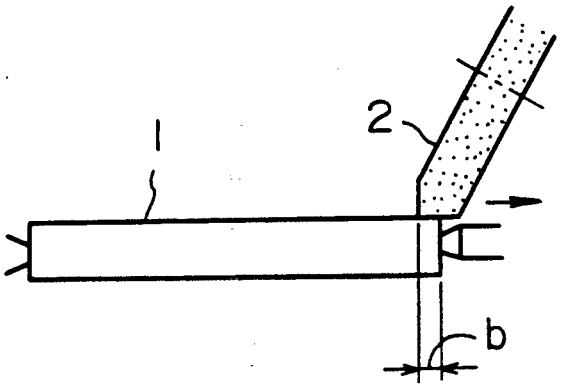
Figure 3:
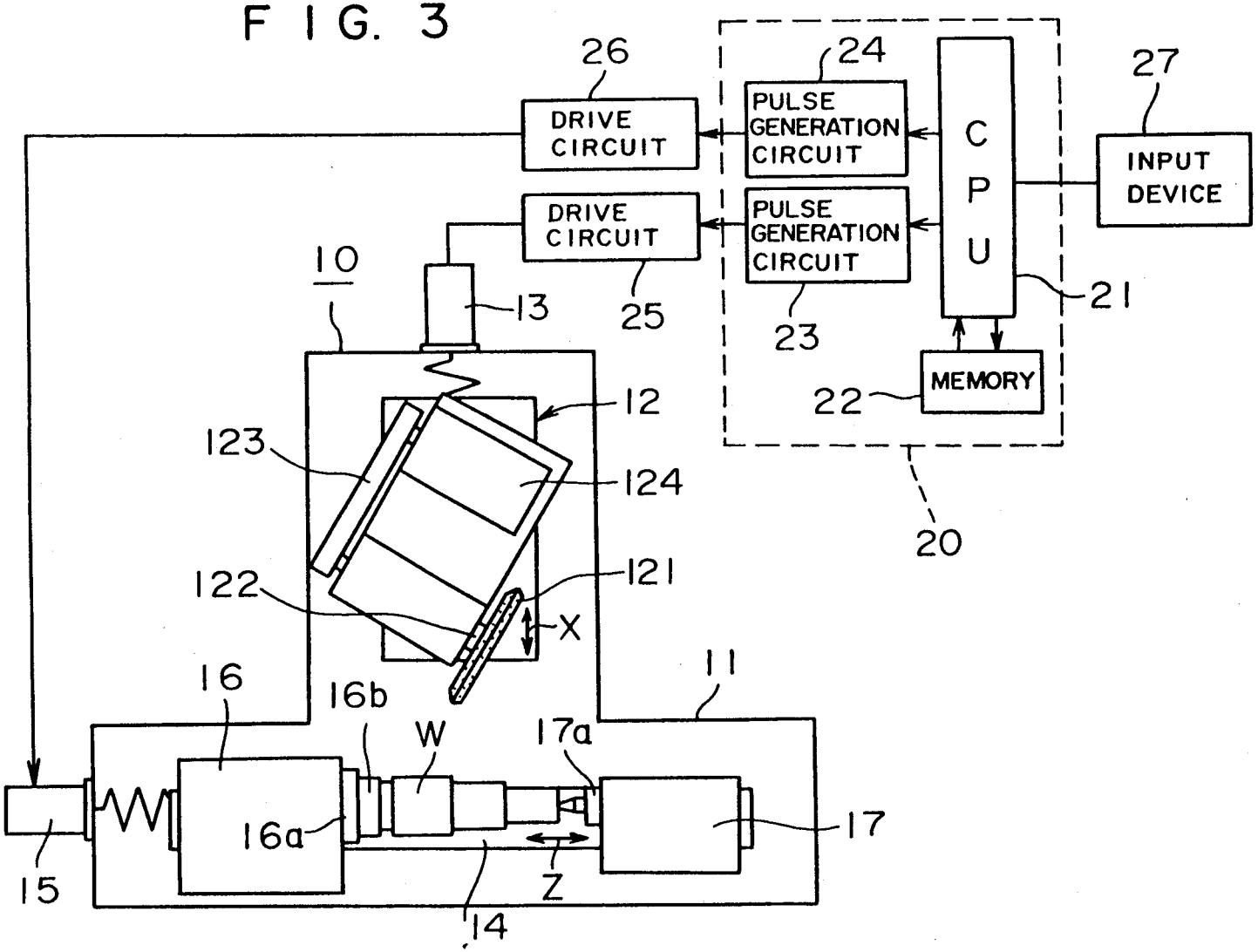
FIG. 3 is a schematic plan view of a grinding machine, which is combined with a block diagram of a numerical controller, according to a first embodiment of the present invention.

Referring now to FIG. 3, numeral 10 denotes a grinding machine, numeral 20 denotes a numerical controller for controlling the grinding machine 10. The grinding machine 10 is provided with a wheel head 12 guided on bed 11 for movement in X-axis direction, and a workpiece table 14 guided on the bed 11 for movement in Z-axis direction perpendicular to the X-axis direction. The wheel head 121 is moved by a servomotor 13 while the table 14 is moved by a servomotor 15.

The wheel head 12 is provided with a wheel spindle 122 carrying a grinding wheel 121 and a drive motor 124, which rotates the wheel spindle 122 at a predetermined speed via a rotational movement transmitting mechanism 123.

Disposed on the table 14 are a spindle head 16 and a tailstock 17 opposing each other. A workpiece W is supported between the spindle head 16 and the tailstock 17 through a chuck device 16*b* attached to a main spindle 16*a* of the spindle head 16 and a center attached to a tailstock spindle 17*a* of the tailstock 17. The spindle head 16 is further provided with a spindle motor (not shown) built in the spindle head 16.

The numerical controller 20 is mainly composed of a central processing unit 21 (hereinafter referred to as "CPU") for controlling entire operation, a memory 22 for storing a machining program and other data, a pulse generation circuit 23 for X-axis, and a pulse generation circuit 24 for Z-axis. These pulse generation circuits 23 and 24 generate pulse signals in response to command data output from the CPU 21.

The pulse generation circuit 23 for X-axis is connected to the servomotor 13 via a drive circuit 25 while the pulse generating circuit 24 for Z-axis is connected to the servomotor 15 via a drive circuit 26. An input device 27 such as an operation panel is connected to the CPU 21 for allowing a machine operator to input a machining program and other data and to input operation commands.

The operation of the grinding machine according to the first embodiment will now be described with reference to the flowchart shown in FIG. 4 and explanatory charts shown in FIGS. 5, 6(*a*) and 6 (*b*).

Figure 5:
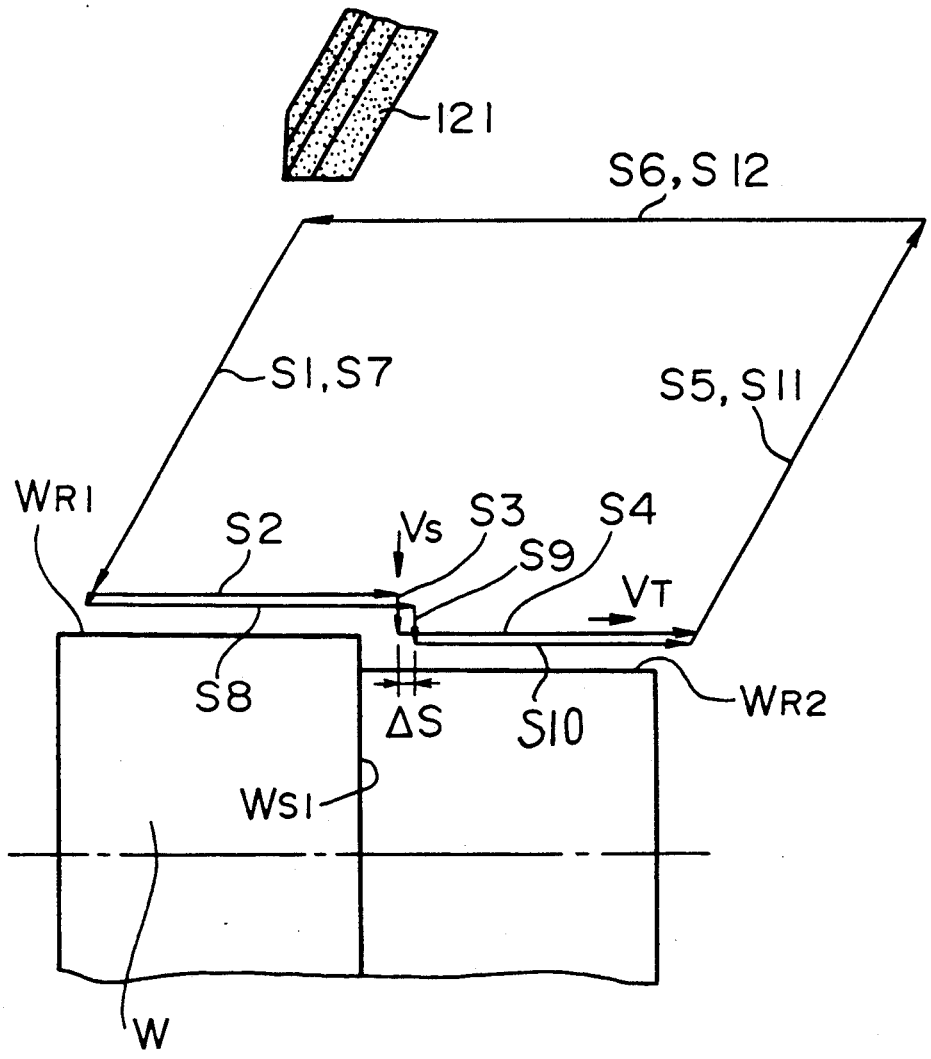
FIG. 5 is an explanatory charts showing a change in the positional relationship between the grinding wheel and the workpiece shown in FIG. 3.

In this instance, the workpiece W has two cylindrical outer surfaces WR1 and WR2 and a shoulder surfaces WS1 located between the outer surfaces WR1 and WR2, as shown in FIG. 5. The cylindrical outer surfaces WR1 and WR2 are ground by a two-step traverse grinding which is composed of a rough traverse grinding and a finish traverse grinding. The shoulder surface WS1 is also ground during the two-step traverse grinding.

Figure 4:
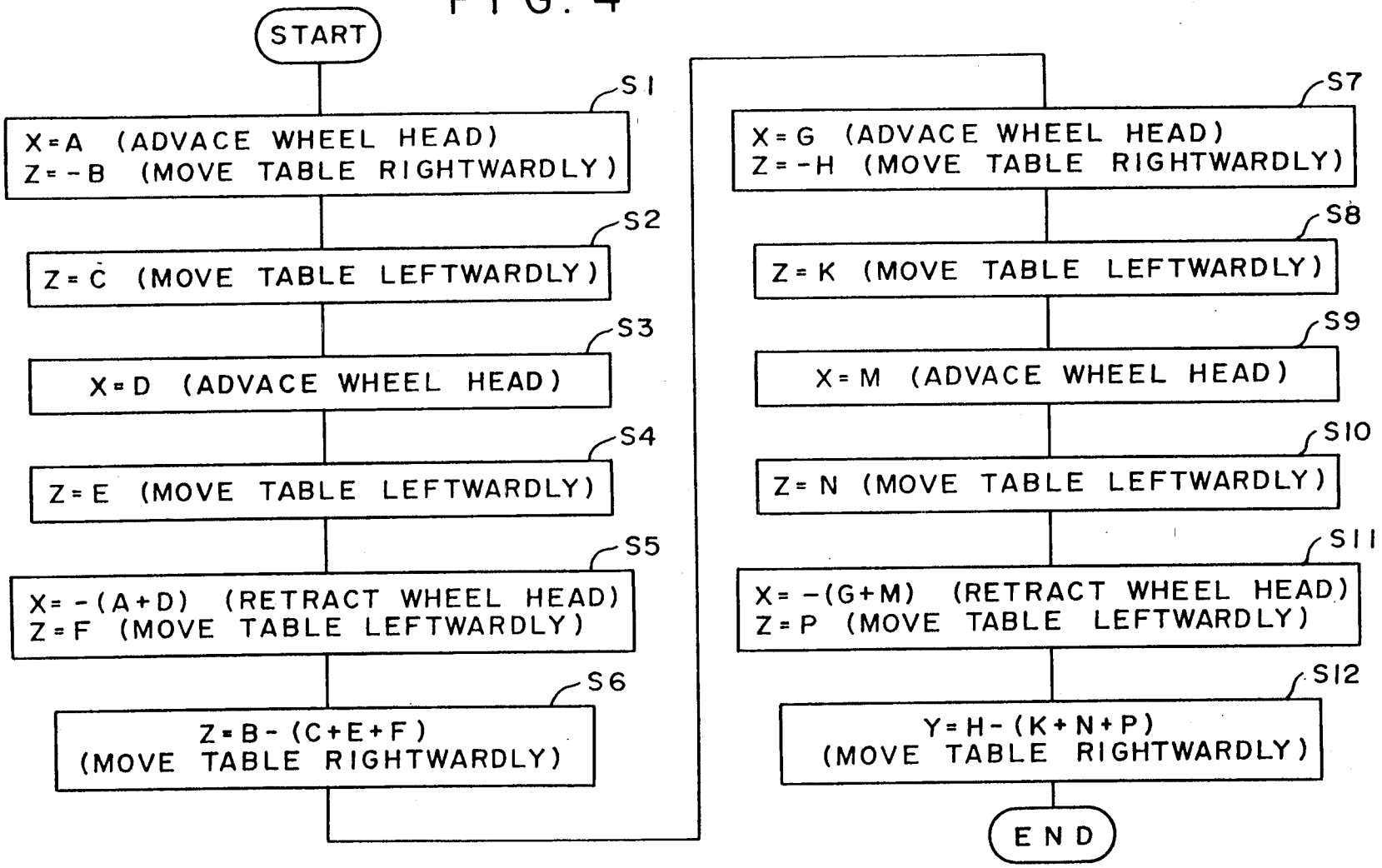
FIG. 4 is a flowchart illustrating the operation of the CPU shown in FIG. 3.

When the operation of the grinding machine is started in response to a command input by the operator through the input device 27, the machining operation shown in FIG. 4 is executed in accordance with the machining program stored in the memory 22 after the rotation of the workpiece W has been started. At first step S1, a command value A for X-axis, i.e., for the wheel head 12, and a command value -B for Z-axis, i.e., for the table 14 are read out from the memory 22, and the wheel head 12 and the table 14 are simultaneously moved in response to the read out command values. Namely, when the command value A is read out by the CPU 21, the CPU 21 outputs command data including the value A to the pulse generation circuit 23 to distribute pulse signals, whose number corresponds to the value A, to the drive circuit 25. In response to this pulse distribution, the servomotor 13 rotates at a commanded speed so that the wheel head 12 is advanced toward the workpiece W by an amount corresponding to the command value A. Similarly, when the command value −B is read out by the CPU 21, the CPU 21 outputs command data including the value −B to the pulse generation circuit 24 so that pulse signals for negative direction, whose number corresponds to the value −B, are distributed to the drive circuit 26. In response to this pulse distribution, the servomotor 15 rotates at a commanded speed so that the table 14 is moved rightwardly by an amount corresponding to the value −B. The movement of the wheel head 12 in X-axis direction and the movement of the table 14 in Z-axis direction simultaneously take place.

Figure 6:
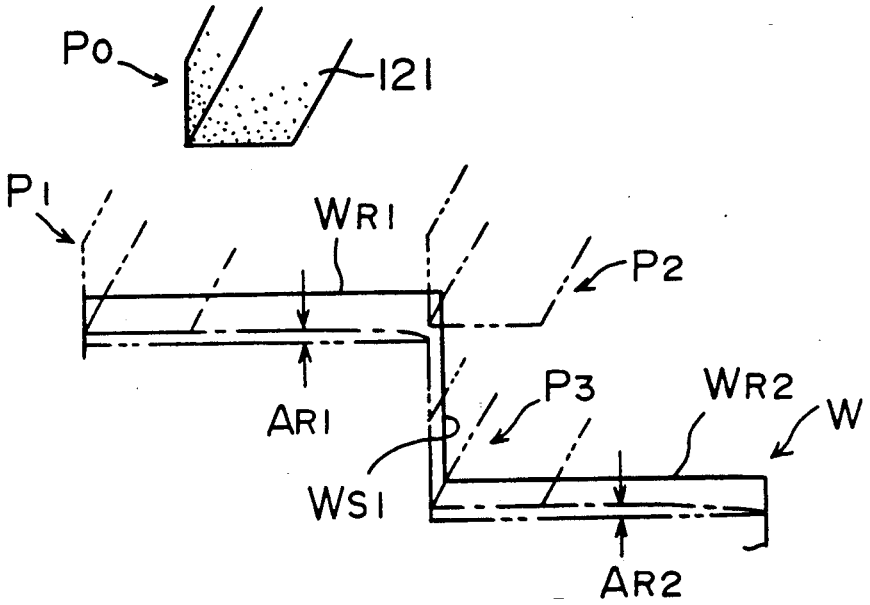
FIG. 6 (*a*) is an explanatory chart showing a change in the positional relationship between the grinding wheel and the workpiece in the rough traverse grinding.
Figure 6:
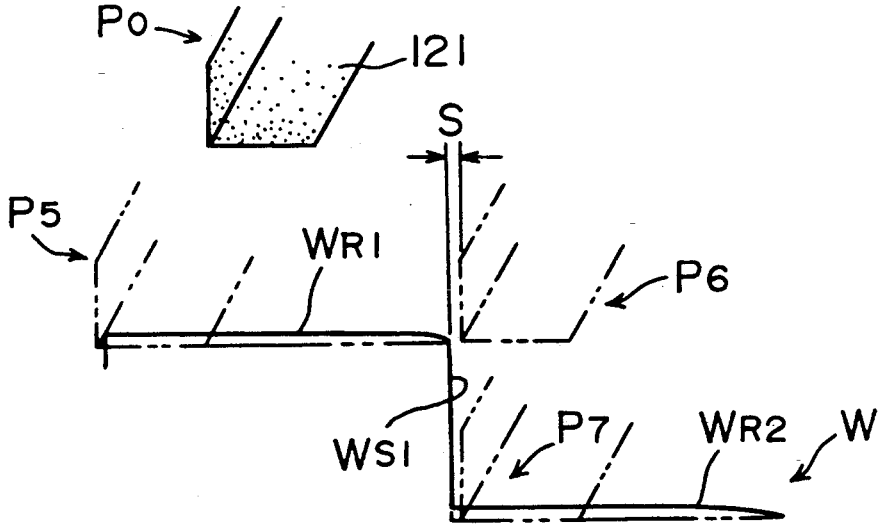

By this operation, the grinding wheel 121 is advanced from an infeed start position P0 toward the workpiece W along an inclined pass as shown in FIGS. 5 and 6 (*a*), and is finally engaged with the outer surface WR1 of the workpiece W so that a predetermined depth of cut is given. The grinding wheel 121 is located at position Pl after such infeed movement. In this instance, the command values A and −B are determined so that a predetermined allowance AR1 remains after the completion of the above mentioned infeed movement. The allowance AR1 is determined to be larger than an amount of excessive removal at the end of the outer surface WR1 which is caused by a traverse grinding described later. By leaving the allowance of such amount, it is possible to leave a sufficient allowance for the finish traverse grinding even when the end of the outer surface WR1 is excessively ground due to a change in the grinding force.

At next step S2, a command value C for Z-axis is read out from the memory 22, and data including the value C is outputted to the pulse generation circuit 24 so that pulse signals for negative direction, whose number corresponds to the value C, are distributed to the drive circuit 26. In response to this pulse distribution, the servomotor 15 rotates at a commanded speed so that the table 14 is moved leftwardly by an amount corresponding to the command value C. With this operation, the whole area of the cylindrical outer surface WR1 is ground, and the grinding wheel 121 is positioned at a position P2 at which the location in Z-axis direction of the shoulder grinding surface of the grinding wheel 121 corresponds to a desired final axial position of a shoulder surface WS1, as shown in FIG. 6 (*a*).

When the processing moves from step S2 to S3, a command value D for X-axis is read out from the memory 22, and the wheel head 12 is advanced by an amount corresponding to the value D. With this operation, the grinding wheel 121 is moved to a position P3 so that the shoulder surface WS1 is ground to have a desired axial position. The command value D is determined so that a predetermined allowance AR2 remains after the above-mentioned shoulder grinding. The allowance AR2 is equal or similar to the allowance AR1.

At next step S4, a command value E for Z-axis is read out from the memory 22, and the table 14 is moved leftwardly by an amount corresponding to the value E. With this operation, the whole area of the second cylindrical surface WR2 is ground.

After the above-mentioned rough traverse grinding, the workpiece W has a shape indicated by a broken line of single dot type in FIG. 6 (*a*). The predetermined allowances AR1 and AR2 remain at the cylindrical outer surfaces WR1 and WR2, respectively, at this point, while the shoulder surface WS1 has been ground to have a desired axial position. The preferred removal amount of the cylindrical outer surfaces WR1 and WR2 in the rough traverse grinding is about 0.3 mm, and the preferred removal amount of the shoulder surface WS1 is about 0.1 mm. Further, the feed speed Vs of the grinding wheel 121 during the shoulder grinding is about one tenth of the traverse speed Vt of the table 14 during traverse grinding for the cylindrical outer surfaces WR1 and WR2.

After the completion of the rough traverse grinding, the processing moves from step 4 to step 5, at which the table 14 is moved leftwardly by an amount corresponding to a command value F for Z-axis. Simultaneously with this, a retraction amount of the wheel head 12 is calculated by adding the command values A and D, and the wheel head 12 is retracted by the calculated retraction amount simultaneously with the leftward movement of the table. With this operation, the grinding wheel 121 is retracted away from the second cylindrical outer surface WR2 of the workpiece W along an inclined path so that the grinding wheel 121 is moved back to its original position. At step S6, the moving amount of the table 14 in rightward direction is calculated by the equation of $Z=B-(C+E+F)$, and the table 14 is moved rightwardly by the calculated amount so that the grinding wheel 121 moves back to its original position.

After these return operations, the finish traverse grinding is started.

At step S7, the wheel head 12 is advanced by an amount corresponding to a command value G read out from the memory 22, while the table 14 is moved rightwardly by an amount corresponding to a command value H read out from the memory 22. With this simultaneous movements of the wheel head 12 and the table 14, the grinding wheel 121 is advanced along the inclined path so as to carry out infeed movement and finally located at a position P5, as shown in FIG. 6(*b*). Since the infeed amount of the wheel head 12 is equal to the sum of the movement amount A of the wheel head 12 at step S1 and the allowance AR1, a leftward end of the cylindrical outer surface WR1 is ground to have a desired final diameter.

After that the processing moves from step S7 to step S8, the table 14 is moved leftwardly by an amount corresponding to a command value K for Z-axis read out from the memory 22 so that the whole area of the outer surface WR1 is ground to have a desired final diameter. Since the amount K of the leftward movement is larger by a predetermined amount as compared to the amount E of the leftward movement at step S2, the grinding wheel 121 is positioned after the above traverse grinding at a position P6 at which a predetermined clearance S (0.01–0.02 mm) is formed between the shoulder surface WS1 and the shoulder grinding surface of the grinding wheel 121. Accordingly, even when the wheel head 12 is advanced, at step S9, by an amount corresponding to a command value M, the shoulder surface WS1 is not ground by the grinding wheel 121. With this operation, a leftward end of the cylindrical outer surface WR1 is ground to have a desired final diameter.

At a next step S10, the table 14 is moved leftwardly by a amount corresponding to a command value N for Z-axis. With this operation, the whole area of the second outer surface WR2 is ground to have a desired final diameter.

Even during the finish traverse grinding, the ends of the cylindrical outer surfaces WR1 and WR2 tend to be ground excessively. The amount of the excessive removal, however, falls in a predetermined tolerance, because the depth of cut during the finish traverse grinding is very small (0.03–0.05 mm) as compared with that during the rough traverse grinding. Since the amount of the depth of cut is very small, the amount of deformation of a workpiece change litter even when the grinding wheel 121 approaches respective ends of the outer surfaces WR1 and WR2.

After the completion of the finish traverse grinding, the table 14 is further moved leftwardly by an amount corresponding to the command value P for Z-axis, at step S11. Simultaneously with this, the wheel head 12 is retracted by an amount obtained by the calculation of $G+M$ to move back to it original position. At final step S12, the table 14 is moved rightwardly by an amount obtained by the calculation of $H-(K+N+P)$ so that the grinding wheel 121 is moved back to its original position.

As is explained above, the outer surfaces WR1 and WR2 are firstly ground by the rough traverse grinding in which the outer surfaces WR1 and WR2 are ground to leave predetermined allowances for finish grinding larger than the amount of excessive removal at the end of each traverse grinding, and the both outer surfaces are then ground by the finish traverse grinding. Therefore, the cylindrical outer surfaces are ground in a short time to have a desired final dimension and a desired cylindricity. Further, since the grinding operation for the shoulder surface WS1, whose grinding speed is slow, is accomplished in the rough traverse grinding only, and not ground in the finish traverse grinding, the total machining time is shorter than double the machining time needed for a single traverse grinding.

Second Embodiment

Since the structure of the grinding machine used in this second embodiment is the same as that of the first embodiment, the explanation of the structure of the grinding machine will be omitted. However, a workpiece having a single cylindrical outer surface is ground in this embodiment. The numerical controller also has the same structure as that of the first embodiment, excepting for contents of the memory 22. In this embodiment, a machining program different from that of the first embodiment and a compensation table are memorized in the memory 22.

In this embodiment, the moving speed of the table 14 is changed so as to maintain the grinding force constant even when the grinding wheel 121 reaches the end of the cylindrical surface of the workpiece. For this purpose, a compensation value table shown FIG. 8 is stored in the memory. In this instance, an end portion of the cylindrical surface at which an excessive removal would occur is divided into a plural small portions. Compensation values for modifying the moving speed of the table 14 are then stored for respective divided small portion. These compensation values are experimentally or mathematically obtained to make the grinding force constant regardless of a change in the width, of the effective portion of the grinding surface which actually carries out the grinding operation.

Figure 7:
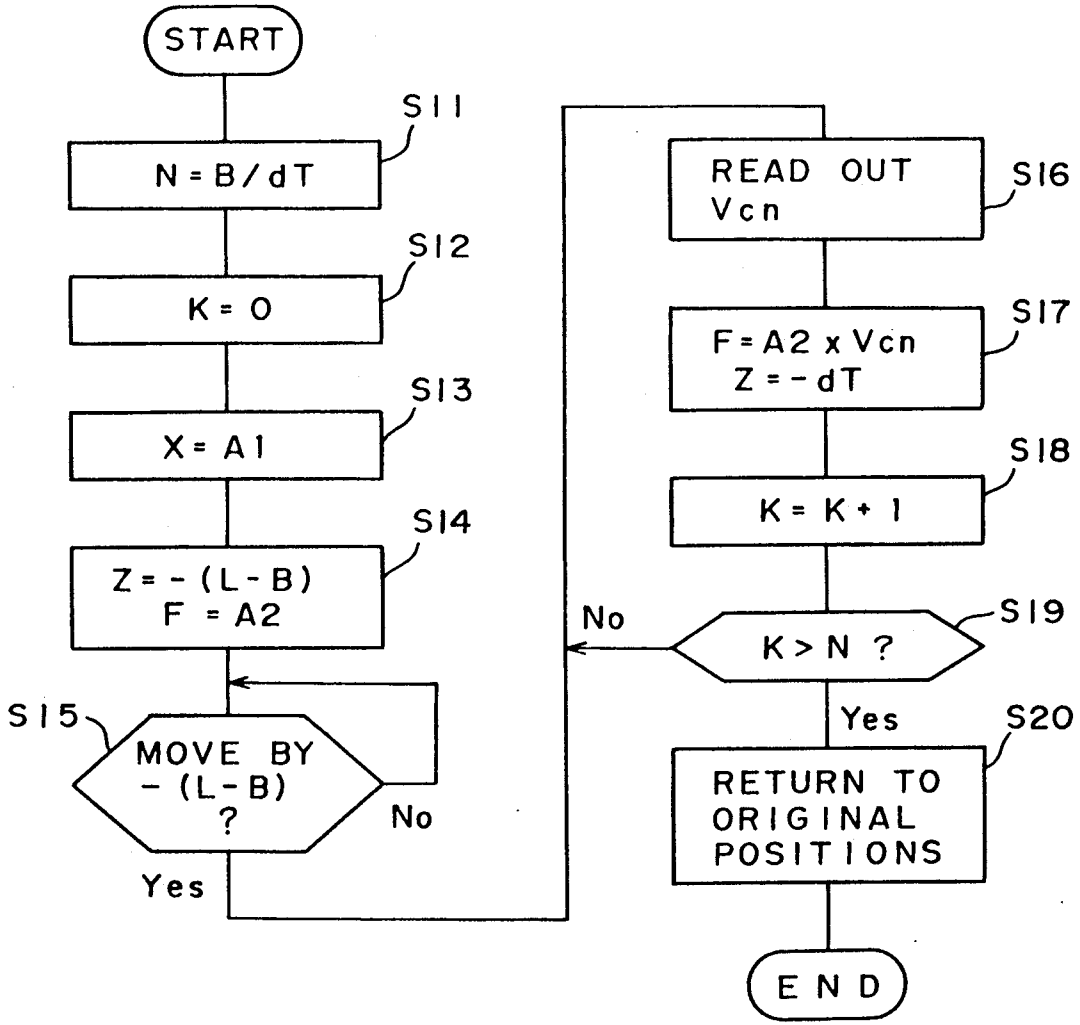
FIG. 7 is a flowchart illustrating the operation of the CPU shown in FIG. 3 according to the second embodiment of the present invention.
Figure 9:
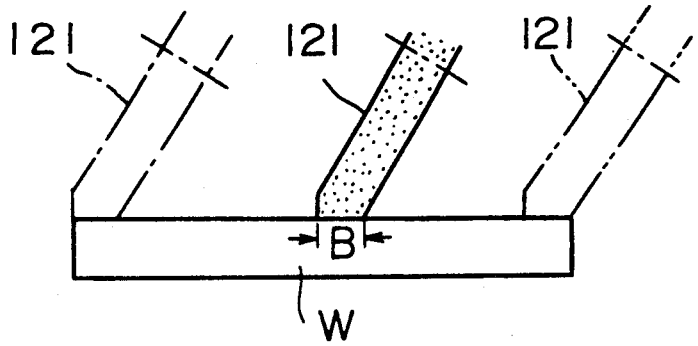
FIG. 9 is an explanatory chart showing a change in the positional relationship between the grinding wheel and the workpiece.
Figure 10:
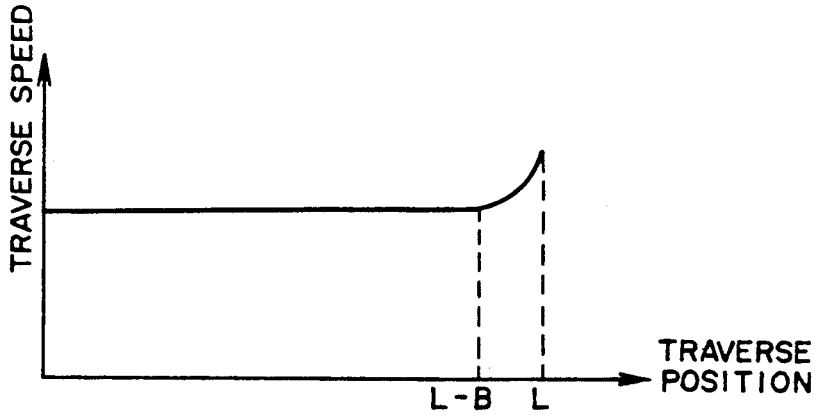
FIG. 10 is an explanatory chart showing a change in traverse speed of the table in the second embodiment.

The operation of the grinding machine according to the second embodiment will now be described with reference to a flowchart shown FIG. 7 and explanatory charts shown in FIGS. 8, 9 and 10, as well as FIG. 3.

At first step S11, the number N of compensation operation is obtained by dividing the width B of the grinding wheel 121 by an unit traverse amount dT, and the content of a control counter K is initially set to zero at step S12.

At next step S13, a command value Al for X-axis, i.e., for the wheel head 12 is read out from the memory 22, and the wheel head 12 is advanced by the amount Al toward the workpiece W. Namely, when the command value Al is read out by the CPU 21, the CPU 21 outputs command data including the value Al to the pulse generation circuit 23 to distribute pulse signals, whose number corresponds to the value Al, to the drive circuit 25. In response to this pulse distribution, the servomotor 13 rotates at a commanded speed so that the wheel head 12 is advanced toward the workpiece W by an amount corresponding to the command value A1. As a result, the grinding wheel 121 is engaged with one end of the cylindrical surface, as indicated by a broken line of single dot type in FIG. 9. Before above operation, the workpiece W has been stated to rotate at a predetermined speed.

At step S14, a command value −(L−B) for movement amount in Z-axis direction and a command value A2 for movement speed F are read out from the memory 22, and data including the values −(L−B) and A2 are outputted to the pulse generation circuit 24 so that pulse signals for negative direction, whose number corresponds to the value L−B, are distributed to the drive circuit 26 at a speed corresponding to the value A2. It is to be noted that the L indicates the length of the workpiece W and B indicates the width of the cylindrical grinding surface of the grinding wheel 121. In response to this pulse distribution, the servomotor 15 rotates at a commanded speed so that the table 14 is moved leftwardly by an amount corresponding to the command value L−B. With this operation, the grinding wheel 121 is axially moved relative to the workpiece W to an axial position corresponding to L−B at which the right hand edge of the cylindrical grinding surface of the grinding wheel 121 corresponds to the right hand edge of the workpiece W whereby the cylindrical outer surface of the workpiece W is ground by the grinding wheel 121. During this operation, the speed of the table 14 is maintained constant as shown in FIG. 10 until the grinding wheel 121 reaches the axial position corresponding to L−B, as indicated by the broken line of two dot type in FIG. 9.

At next step S15, it is judged whether or not the table 14 reaches the axial position corresponding to L−B. When it is judged that the table 14 has reached the axial position corresponding to L−B, the processing moves from step S15 to S16 at which a compensation value Vcn is read out from the memory position of the compensation table designated by the content K of the control counter. Since the content K is zero at this point, "1.0" is read out as a compensation value.

At following step S17, a compensated speed for the table 14 is calculated by multiplying the command speed A2 and the read out compensation value Vcn. After that, the table 14 is moved leftwardly by a predetermined amount corresponding to the unit traverse amount dT at the compensated speed. After that, the content K of the control counter is incremented by one at step S18.

At step S19, it is judged whether or not the content K of the control counter exceeds the value N. When the content K does not exceed the value N, the processing moves back to step S16 for repeating the processing at steps S16 to S19. As a result, the compensation values memorized in the compensation table are sequentially read out to modify the traverse speed of the table 14 so that the traverse speed of the table 14 is increased as shown in FIG. 10. With this, the grinding force of the grinding wheel 121 is made constant even when only part of the cylindrical grinding surface of the grinding wheel 121 is engaged with the cylindrical surface of the workpiece W. Therefore, its is possible to prevent the right hand end of the workpiece from being excessively ground due to the decrease of the grinding force, thereby increasing the cylindricity of the cylindrical surface.

When the content K exceeds the value N, the processing moves from step S19 to step S20 at which the wheel head 12 is retracted, and the table 14 is then moved rightwardly to go back to its original position.

Although the grinding force is made constant by changing the traverse speed of the table 14 in the above-mentioned embodiment, it is possible to make the grinding force constant by changing one or more of other grinding conditions such as the rotational speed of the workpiece, the peripheral speed of the grinding wheel. When the rotational speed of the workpiece is controlled, the rotational speed is decreased when the grinding wheel approaches the right hand end of the cylindrical surface. When the peripheral speed of the grinding wheel is controlled, the peripheral speed is decreased by lowering the rotational speed of the grinding wheel 121 when the grinding wheel approaches the right end of the cylindrical surface. Further, the problem of excessive removal of cylindrical surface can be solved by changing the radial position of the grinding wheel so that the depth of cut is gradually getting smaller when the grinding wheel approaches the one end of the cylindrical surface.

Third Embodiment

Since the structure of the grinding machine used in this third embodiment is the same as that of the first embodiment, the explanation of the structure of the grinding machine will be omitted. However, the grinding machine is further provided with a measuring device 18 mounted on the bed 11 to measure the diameter of a cylindrical outer surface Wb of a workpiece W, as shown in FIG. 11. The numerical controller has the same structure as that of the first embodiment. In this embodiment, the diameter of the cylindrical surface Wb is measured during a traverse grinding to change the position of the wheel head 12.

Figure 12:
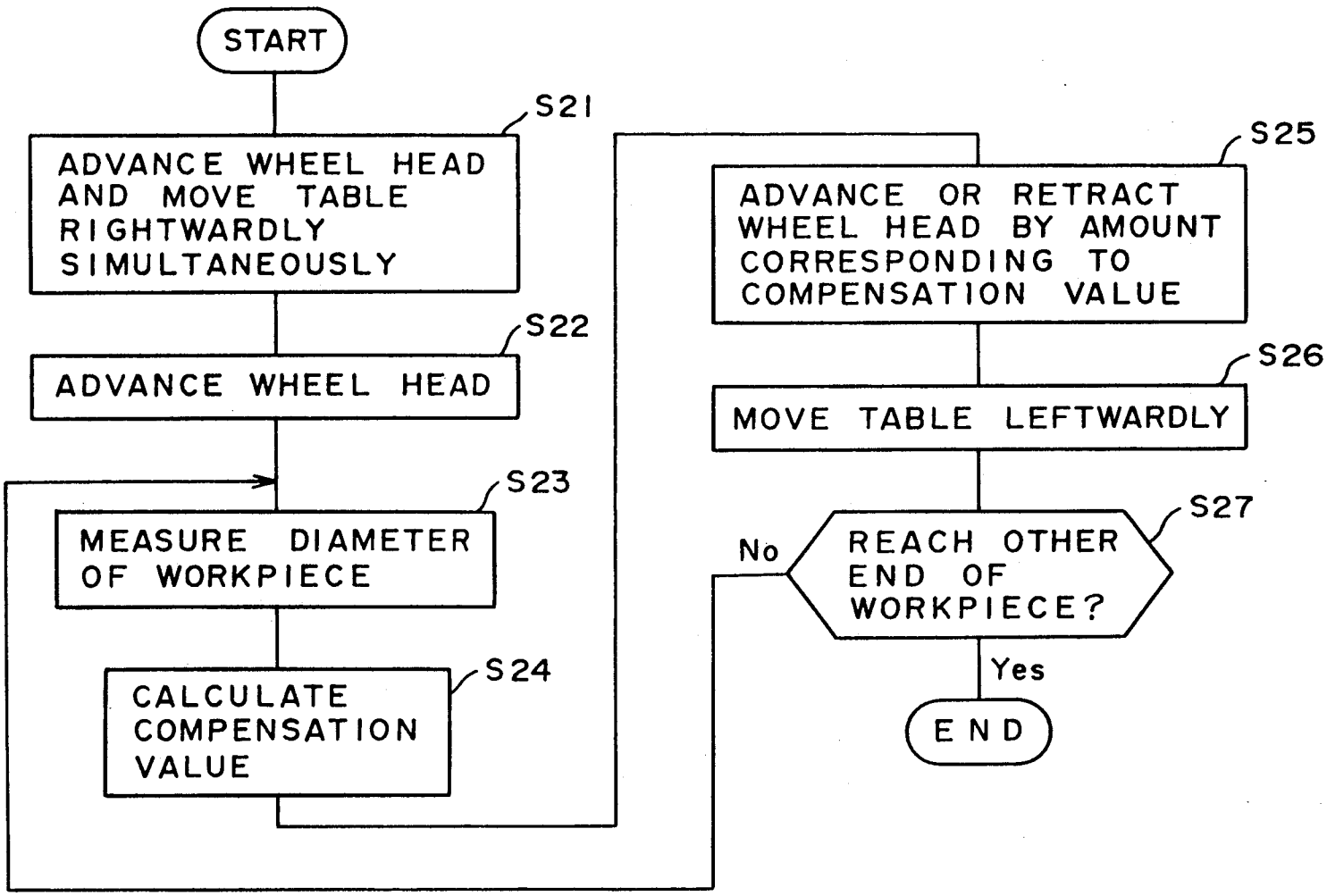
FIG. 12 is a flowchart illustrating the operation of the CPU shown in FIG. 11.

When the operation of the grinding machine is started in response to a command input by the input device 27, the machining operation shown in FIG. 12 is executed in accordance with the machining program stored in the memory 22. At first step S21, the wheel head 12 is advanced and the table 14 is moved rightwardly simultaneously with the advance movement of the wheel head 12. By this operation, the grinding wheel 121 is advanced from the infeed starting position P10 toward the workpiece W along an inclined path, and finally positioned at a position P11 shown in FIG. 16.

At next step S22, the wheel head 12 is further advanced while the table 14 stays at the same position. With this operation, a shoulder surface Wa and the left hand end of the cylindrical surface Wb are ground to have desired dimensions. After this operation, the grinding wheel 121 is located at a position P12.

At step S23, the diameter of the cylindrical surface Wb is detected based on the output signal from the measuring device 18, and the measured diameter is compared with a desired final dimension of the cylindrical surface Wb, at step S24, to calculate a difference therebetween as a compensation value. The desired final dimension has been inputted by an operator in advance, and is stored in the memory 22.

At next step S25, a pulse generation command is output from the CPU 21 to the pulse generation circuit 23 for generating pulse signals for changing the position of the wheel head 12. Namely, pulse signals whose number correspond to the compensation value are output to the drive circuit 25 so that the wheel head 12 is advanced or retracted by an amount corresponding to the compensation value. With this operation the position of the wheel head 12 is changed to accurately grind the cylindrical surface Wb into a desired final diameter.

At step S26, a command data for leftwardly movement of the table 14 is output from the CPU 21 to the pulse generation circuit 24 so that pulse signals for leftward movement of a predetermined amount are distributed to the drive circuit 26. With this pulse distribution, the table 14 is moved leftwardly by a predetermined amount to grind the cylindrical surface Wb of the workpiece W.

At step S27, it is judged that the grinding wheel 121 reaches a position P13 corresponding to the right hand end of the cylindrical surface Wb of the workpiece W. When it is judged at step S27 that the grinding wheel 121 does not reach the other end of the cylindrical surface Wb, the processing moves from step S27 to step S23 to repeat the processing at steps S23 to S27. On the contrary when it is judged at step S27 that the grinding wheel 121 reaches the other end of the cylindrical surface Wb, the processing ends. The wheel head 12 and table 14 are thereafter moved to their original positions.

As described above, the radial position of the grinding wheel is changed, based upon the measured diameter of the cylindrical surface Wb, so that the entire portion of the cylindrical surface Wb has the desired final dimension. Therefore, it is possible to improve the cylindricity of the cylindrical surface Wb.

Fourth Embodiment

Since the structure of the grinding machine used in this forth embodiment is the same as that of the third embodiment, the explanation of the structure of the grinding machine will be omitted. Although the numerical controller also has the same structure as that of the third embodiment, the memory 22 stores a compensation value table and a trial machining program other than an ordinary machining program, as shown in FIG. 14. In this embodiment, a counter 32 for detecting the present position of the table 14 is also used.

In this embodiment, the diameter of a cylindrical surface Wb is measured during a trial machining to obtain compensation values for changing the position of the wheel head 12, and the obtained compensation values are memorized in the compensation value table. In the machining operation, the position of the wheel head 12 is changed in accordance with the compensation valued memorized in the compensation value table.

The operation of the grinding machine according to the forth embodiment will now be described with reference to the flowchart shown in FIG. 13 (*a*), 13 (*b*) and explanatory charts shown in 14, 15 and 16, as well as FIG. 11.

1. Trial Machining

The numerical controller 20 is firstly put into the trial machining mode under the state that a trial workpiece W is supported by the spindle head 16 and the tailstock 17.

When a start command input by an operator, the CPU 21 executes the trial machining program shown in FIG. 13 (*a*).

At first step S31, the wheel head 12 is advanced, and table 14 are moved rightwardly simultaneously with the advance movement of the wheel head 12 so that the grinding wheel 121 is moved to the position P11, as shown in FIG. 16.

At next step S32, the wheel head 12 is further advanced while the table 14 stays at the same position. With this operation, a shoulder surface Wa and the left hand end of the cylindrical surface Wb are ground to have desired dimensions.

At step S33, the diameter of the cylindrical surface Wb is measured by the measuring device 18, and the measured diameter is compared with a desired final dimension of the cylindrical surface, at step S34, to calculate a difference therebetween as a compensation value. The desired final dimension has been inputted by an operator in advance.

At step S35, the CPU 21 reads out the content of the counter 32, which counts the number of pulse signals output from the pulse generation circuit 24 to detects the present position of the table 14. After that, the compensation value is memorized in the compensation value table together with the present position of the table 14.

At step S36, the servomotor 15 is driven in response to pulse signals distributed from the pulse generating circuit 24 so that the table 14 is moved leftward by a predetermined amount. At next step S38, it is judged whether or not the grinding wheel 121 reaches the other end of the cylindrical surface Wb of the workpiece W. When it is judged at step S37 that the grinding wheel 121 does not reach the other end of the cylindrical surface Wb, the processing moves from step S37 to step S33 to repeat the processing at steps S33 to S37. On the contrary when it is judged at step S37 that the grinding wheel 121 reaches the other end of the cylindrical surface Wb, the processing ends. The wheel head 12 and table 14 are thereafter moved to their original positions.

With the above-mentioned operation, the compensation values at different axial positions of the cylindrical surface Wb are measured, and memorized in the compensation value table together with the data indicating the axial positions at which the measurement of the diameter has been taken place.

2. Machining Operation

After the numerical controller 20 is put into the machining operation, a new workpiece W is attached between the spindle head 16 and tailstock 17. When a start command is inputted by the operator under such condition, the CPU 21 executes the processing for machining shown in FIG. 13 (*b*).

At first step S41, the wheel head 12 is advanced, and table 14 are moved rightwardly simultaneously with the advance movement of the wheel head 12.

At next step S42, the wheel head 12 is further advanced while the table 14 stays at the same position. With this operation, a shoulder surface Wa and a part of the cylindrical surface Wb are ground to have desired dimensions.

At step S43, the present position of the table 14 is detected based upon the content of the counter 32. After that one of compensation values corresponding to the detected present position is read out from the compensation value table memorized in the memory 22, at step S44.

At next step S45, the pulses whose number corresponds to the read out compensation value are distributed to the drive circuit 25 so as to advance or retract the wheel head 12. With this operation the position of the grinding wheel in X-axis direction is changed in accordance with the compensation value. At next step S46, the table 14 is moved leftwardly by a predetermined amount to carry out a traverse grinding.

At step S47, it is judged whether or not the grinding wheel 121 reaches the other end of the cylindrical surface Wb of the workpiece W. When it is judged at step S47 that the grinding wheel 121 does not reach the other end of the cylindrical surface Wb, the processing moves from step S47 to step S43 to repeat the processing at steps S43 to S47. With this operation, the position of the wheel head 12 is continuously changed in accordance with the compensation values, and such operation is continued until the whole area of the cylindrical surface Wb is ground.

On the contrary, when it is judged at step S47 that the grinding wheel 121 reaches the other end of the cylindrical surface Wb, the processing ends. The wheel head 12 and table 14 are thereafter moved to their original positions.

As is explained above, the position of the wheel head is compensated based upon the compensation values so that the entire area of the cylindrical surface has the desired final diameter. Therefore, it is possible to grind the cylindrical surface with a high cylindricity.

Although the table is moved for producing a traverse movement of the grinding wheel in the above-mentioned embodiments, the traverse movement may be obtained by moving the wheel head in a direction parallel to the rotational axis of a workpiece.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding a cylindrical surface of a workpiece with a rotating grinding wheel having a grinding surface narrower than the axial length of the cylindrical surface, said method comprising the steps of:

rotating said workpiece about the center axis thereof;

advancing said grinding wheel relative to said workpiece from an infeed start position toward one end of the cylindrical surface to grind the one end of the cylindrical surface into a predetermined intermediate diameter larger than a desired final diameter by a predetermined finish allowance;

effecting a first relative movement between said grinding wheel and said workpiece for moving said grinding wheel relative to said workpiece in a traverse direction parallel to the center axis of said workpiece toward the other end of the cylindrical surface to grind the wheel area of the cylindrical surface, said first relative movement continuing until at least a portion of said grinding wheel surface extends axially beyond the cylindrical surface, wherein the other end of said cylindrical surface is subject to excessive grinding;

advancing said grinding wheel toward the cylindrical surface to grind a part of the cylindrical surface into the desired final diameter; and effecting a second relative movement between said grinding wheel and said workpiece for moving said grinding wheel relative to said workpiece in a traverse direction parallel to the center axis of said workpiece to grind the whole area of the cylindrical surface into the desired final diameter, said second relative movement continuing until at least a portion of said grinding wheel surface extends axially beyond the cylindrical surface, and wherein the finish allowance is determined to be larger than an amount of the excessive grinding at the other end of the cylindrical surface during the first traverse movement of said grinding wheel.

2. A method of grinding a cylindrical surface of a workpiece according to claim 1, wherein said workpiece further has a shoulder surface to be ground which is formed at a location adjacent to the cylindrical surface, and the shoulder surface is ground only by said first advancing step for said grinding wheel to have a desired final axial position.

3. A method of grinding a cylindrical surface of a workpiece with a rotating grinding wheel having a grinding surface narrower than the axial length of said cylindrical surface, said method comprising the steps of:

rotating said workpiece about the center axis thereof;

advancing said grinding wheel relative to said workpiece from an infeed start position and by an infeed distance toward one end of the cylindrical surface to grind the one end of the cylindrical surface into a predetermined diameter;

effecting a relative movement between said grinding wheel and said workpiece for moving said grinding wheel relative to said workpiece in a traverse direction parallel to the center axis of said workpiece toward the other end of the cylindrical surface to grind the whole are of the cylindrical surface, said relative movement continuing until at least a portion of said grinding wheel surface extends axially beyond the cylindrical surface;

modifying the infeed distance when the grinding wheel approaches the other end of the cylindrical surface such that grinding force is kept constant regardless of a change in the width of an effective portion of the grinding surface which contacts with the cylindrical surface.

4. A grinding machine for grinding a cylindrical surface of a workpiece with a rotating grinding wheel having a grinding surface narrower than the axial length of said cylindrical surface, said grinding machine comprising:

means for rotating said workpiece about the center axis thereof;

means for advancing said grinding wheel relative to said workpiece from an infeed start position and by an infeed distance toward one end of the cylindrical surface to grind the one end of the cylindrical surface into a predetermined diameter;

means for effecting a relative movement between said grinding wheel and said workpiece to move said grinding wheel relative to said workpiece in a traverse direction parallel to the center axis of said workpiece toward to other end of the cylindrical surface to grind the whole area of the cylindrical surface, said relative movement continuing until at least a portion of said grinding wheel surface extends axially beyond the cylindrical surface;

means for modifying the infeed distance when the grinding wheel approaches the other end of the cylindrical surface so that grinding force is kept constant regardless of a change in width of an effective portion of the grinding surface which contacts with the cylindrical surface.

5. A grinding machine for grinding a cylindrical surface of a workpiece according to claim 4, wherein said means for modifying comprises a compensation value table for storing compensation values corresponding to plural axial positions of said grinding wheel at which the infeed distance is modified, means for reading out the compensation values successively in accordance with a change in the axial position of said grinding wheel, and means for modifying the infeed distance based on the read out compensation values.

6. A method of grinding a cylindrical surface of a workpiece with a rotating grinding wheel having a grinding surface narrower than the axial length of said cylindrical surface, said method comprising the steps of:

rotating said workpiece about the center axis thereof;

advancing said grinding wheel relative to said workpiece from an infeed start position toward one end of the cylindrical surface to grind the one end of the cylindrical surface into a predetermined diameter;

effecting a relative movement between said grinding wheel and said workpiece for moving said grinding wheel relative to said workpiece in a traverse direction parallel to the center axis of said workpiece toward the other end of the cylindrical surface to grind the whole are of the cylindrical surface, said relative movement continuing until at least a portion of said grinding wheel grinding surface extends axially beyond the cylindrical surface;

changing the relative position of the grinding wheel in a direction perpendicular to the center axis of said workpiece so that the cylindrical surface is ground to have a desired final diameter at any axial location.

7. A method of grinding a cylindrical surface of a workpiece according to claim 6, wherein said method further comprises steps of:

measuring a diameter of the cylindrical surface at an axial location at which the cylindrical surface is being ground by said grinding wheel; and calculating a compensation value based upon a difference between the measured diameter and a desired diameter, and wherein the relative position of the grinding wheel is changed according to the calculated compensation value.

8. A method of grinding a cylindrical surface of a workpiece with a rotating grinding wheel having a grinding surface narrower than the axial length of the cylindrical surface, said method comprising the steps of:

advancing said grinding wheel toward one end of a cylindrical surface of a trial workpiece to grind the one end of the cylindrical surface into a predetermined dimension;

effecting a relative movement between said grinding wheel and said trial workpiece for moving said grinding wheel relative to said trial workpiece in a traverse direction parallel to the center axis of said trial workpiece toward the other end of the cylindrical surface to grind the whole area of the cylindrical surface;

measuring the diameter of the cylindrical surface at different axial positions of the cylindrical surface;

calculating compensation values for the different axial positions based upon differences between the measured diameters and a desired final dimension;

replacing said trial workpiece with a new workpiece;

advancing said grinding wheel toward one end of a cylindrical surface of the next workpiece to grind the one of the cylindrical surface into a predetermined dimension;

effecting a relative movement between said grinding wheel and said new workpiece for moving said grinding wheel relative to said new workpiece in a traverse direction parallel to the center axis of said workpiece toward the other end of the cylindrical surface to grind the whole area of the cylindrical surface of said new workpiece;

obtaining one of the compensation value corresponding to the present relative position of the grinding wheel in the traverse direction; and changing the position of said grinding wheel in the direction perpendicular to the center axis of said new workpiece in accordance with the obtained compensation values.

9. A grinding apparatus for grinding a cylindrical surface of a workpiece with a rotating grinding wheel having a grinding surface narrower than the axial length of said cylindrical surface, said grinding apparatus comprising:

means for advancing said grinding wheel toward one end of a cylindrical surface of a workpiece to grind the one end of the cylindrical surface into a predetermined dimension;

means for effecting a relative movement between said grinding wheel and said workpiece to move said grinding wheel relative to said workpiece in a traverse direction parallel to the center axis of said workpiece toward the other end of the cylindrical surface to grind the whole area of the cylindrical surface;

means for measuring the diameter of the cylindrical surface at different axial positions of the cylindrical surface;

means for calculating a compensation value based upon difference between the measured diameter and a desired final dimension;

means for changing the position of said grinding wheel in the direction perpendicular to the center axis of said workpiece in accordance with the compensation values.

10. A grinding apparatus for grinding a cylindrical surface of a workpiece with a rotating grinding wheel having a grinding surface narrower than the axial length of said cylindrical surface, said grinding apparatus comprising:

means for advancing said grinding wheel toward one end of a cylindrical surface of a trial workpiece to grind the one end of the cylindrical surface into a predetermined dimension;

means for effecting a relative movement between said grinding wheel and said trial workpiece to move said grinding wheel relative to said trial workpiece in a traverse direction parallel to the center axis of said trial workpiece toward the other end of the cylindrical surface to grind the whole area of the cylindrical surface of said workpiece;

means for measuring the diameter of the cylindrical surface at different axial positions of the cylindrical surface;

means for calculating compensation values for the different axial positions based upon differences between the measured diameters and a desired final dimension;

means for advancing said grinding wheel toward one end of a cylindrical surface of a new workpiece to grind the one end of the cylindrical surface into a predetermined dimension;

means for effecting a relative movement between said grinding wheel and said new workpiece to move said grinding wheel relative to said new workpiece in a traverse direction parallel to the center axis of said new workpiece toward the other end of the cylindrical surface to grind the whole area of the cylindrical surface of said new workpiece; and means for obtaining one of the compensation value corresponding to the present relative position of the grinding wheel in the traverse direction; and means for changing the position of said grinding wheel in the direction perpendicular to the center axis of said new workpiece in accordance with the obtained compensation values.

* * * * *